US007357857B2

(12) United States Patent
Hart et al.

(10) Patent No.: US 7,357,857 B2
(45) Date of Patent: Apr. 15, 2008

(54) PROCESS FOR EXTRACTING BITUMEN

(75) Inventors: Paul R. Hart, Sugar Land, TX (US); Edward M. Maharajh, Calgary (CA)

(73) Assignee: Baker Hughes Incorporated, Houston, TX (US)

( * ) Notice: Subject to any disclaimer, the term of this patent is extended or adjusted under 35 U.S.C. 154(b) by 107 days.

(21) Appl. No.: 10/999,024

(22) Filed: Nov. 29, 2004

(65) Prior Publication Data

US 2006/0113218 A1 Jun. 1, 2006

(51) Int. Cl.
*C10G 1/04* (2006.01)
*C10G 1/00* (2006.01)

(52) U.S. Cl. ..... 208/391; 208/390; 208/435

(58) Field of Classification Search ..... 208/390, 208/391, 435
See application file for complete search history.

(56) References Cited

U.S. PATENT DOCUMENTS 2,598,234 A * 5/1952 Keiser et al. ..... 568/609
3,929,625 A * 12/1975 Lucas ..... 208/188
4,416,754 A * 11/1983 Merchant et al. ..... 204/561
4,640,767 A 2/1987 Zajic et al. ..... 208/390
5,282,984 A * 2/1994 Ashrawi ..... 507/255
6,214,213 B1 4/2001 Tipman et al. ..... 208/390

* cited by examiner

*Primary Examiner*—Glenn Caldarola
*Assistant Examiner*—John Douglas
(74) *Attorney, Agent, or Firm*—Madan, Mossman & Sriram, P.C.

(57) ABSTRACT

Bitumen extraction done using a process comprising: (a) preparing a bitumen froth comprising particulate mineral solids and hydrocarbons dispersed in aqueous lamella in the form of an emulsion; (b) adding a sufficient amount of a paraffinic solvent to the froth to induce inversion of the emulsion and precipitate asphaltenes from the resultant hydrocarbon phase; (c) mixing the froth and the solvent for a sufficient time to dissolve the solvent into the hydrocarbon phase to precipitate asphaltenes; and (d) subjecting the mixture to gravity or centrifugal separation for a sufficient period to separate substantially all of the water and solids and a substantial portion of the asphaltenes from the bitumen; wherein a separation enhancing additive is present in the process. The separation enhancing additive is a polymeric surfactant that has multiple lipophilic and hydrophilic moieties, which can effect easier handling of asphaltene sludges and less foaming during solvent recovery.

12 Claims, No Drawings

PROCESS FOR EXTRACTING BITUMEN

FIELD OF THE INVENTION

This invention relates to a process for extracting bitumen. This invention particularly relates to a process for extracting bitumen from matrixes including bitumen and mineral solids.

BACKGROUND OF THE ART

Bitumen is a petroleum hydrocarbon used as a feedstock in the production of synthetic crude oil. For purposes of the present invention, bitumen is defined as high molecular weight hydrocarbons that are solid at ambient temperatures and mostly soluble in alkanes such as hexane. Bitumen recovered from sources such as tar sands or oilsands generally include a component commonly referred to as asphaltenes. The asphaltene component generally consists of hydrocarbons having a higher molecular weight than the bulk of the bitumen, and includes polynuclear aromatic species and metal porphyrins. By definition, asphaltenes are insoluble in alkanes. The asphaltenes, if present in too high of a concentration in the bitumen, cause a number of problems in downstream processing, from emulsification to fouling to poisoning of catalysts, and degrade the value of the synthetic crude produced.

There have been many efforts in the past to extract bitumen from matrixes that include mineral solids. U.S. Pat. No. 4,640,767 to Zajic, et al., discloses the use of materials of a biological origin in extracting hydrocarbons from minerals deposits. It is disclosed therein that microorganisms can be used to prepare a "separation effecting material" by means of fermentation.

A process for extracting bitumen from oilsands is disclosed in U.S. Pat. No. 6,214,213 B1 to Tipman, et al. In this process, a paraffinic solvent is used to separate the bitumen from undesirable mineral solids. Although this process can be run without precipitating asphaltenes, it is advantageous to remove asphaltenes to facilitate processing at lower temperatures (40-50° C.) and into higher quality crude. When the amount of solvent added is high enough to cause asphaltenes to precipitate, the asphaltene content in the bitumen settles out in the same direction as the water and mineral. This, however, produces an asphaltene and solids residue that cannot be removed from a vessel by conventional means.

SUMMARY OF THE INVENTION

In one aspect, the present invention is a process for extracting bitumen from a matrix including solids comprising: (a) preparing a bitumen froth comprising particulate mineral solids and hydrocarbon collected in an aqueous lamellar phase in the form of an emulsion; (b) adding a sufficient amount of paraffinic solvent to the froth to induce inversion of the emulsion into a hydrocarbon continuous, asphaltene precipitating phase; (c) mixing the froth and the solvent for a sufficient time to dissolve the solvent into the hydrocarbonaceous phase and so precipitate the asphaltenes; and (d) subjecting the mixture to gravity or centrifugal separation for a sufficient period to separate substantially all of the water and solids and a substantial portion of the asphaltenes from the diluted bitumen; wherein a separation enhancing additive is present in the process.

It would be desirable in the art of producing asphaltenes, or of deasphalted bitumen, to use a process that does not produce an irremovable or otherwise difficult to handle asphaltene material. It would also be desirable in the art to use a process that reduces foaming during recovery of the solvent from the so separated asphaltenes by gas stripping or evaporation.

DETAILED DESCRIPTION OF THE PREFERRED EMBODIMENT

In one embodiment, the present invention is a process for extracting bitumen from a matrix including mineral solids. Exemplary of such matrices are oilsands. The deposits of tar-like bitumen in central and northern Alberta are among the world's largest petroleum resources. This bitumen is too thick, unheated, to flow through rocks, wellbores, and pipelines. One method of producing bitumen is mining. Mineable bitumen deposits are located near the surface and can be recovered by open-pit techniques. In such operations, oilsands may be scooped up into trucks with shovels or sucked up as aqueous slurries into pipelines and transported to a recovery unit.

Bitumen can also be produced from subsurface deposits. In-situ production methods are used on bitumen deposits buried too deep for mining to be economical. These techniques include steam injection, solvent injection, and firefloods, the last in which oxygen is injected and part of the resource burned to provide heat. Of these, steam injection has been the generally favored method.

Once the bituminous ore is mined, the crude bitumen must be separated from its co-produced mineral matrix. One method of achieving this is a process wherein the crude bitumen is mixed with hot water and caustic in a rotating tumbler to produce a slurry. The slurry is screened to remove oversized solids and other easily separable materials. The screened slurry is diluted with additional hot water and the product is then temporarily retained in a vessel, referred to as a primary separation vessel ("PSV"). In the PSV, bitumen globules contact and coat air bubbles which have been entrained in the slurry in the tumbler. The buoyant bitumen-bubble aggregates rise through the slurry, along with some mineral-bubble aggregates, and form a mineral contaminated bitumen froth. The unassociated sand in the slurry settles and is discharged from the base of the PSV, together with some water and a small amount of bitumen. This stream is referred to as "PSV underflow". "Middlings", comprising water with neutrally buoyant bitumen-mineral-bubble aggregates, collect in the mid-section of the PSV.

The froth is recovered and mixed with a paraffinic solvent in an amount sufficient to produce a solvent to froth ratio ("S/F") of at least 0.6 (w/w). The froth and solvent are mixed sufficiently to fully dissolve the solvent into the bitumen. The resulting mixture is subjected to gravity or centrifugal separation for sufficient time to reduce the water plus solids content of the hydrocarbon phase to less than about 0.5 wt %.

In the practice of the present invention, any paraffinic solvent can be used. Preferably, the solvent used is natural gas condensate, a natural mixture of low molecular weight alkanes with chain lengths from about $C_3$-$C_{16}$, mostly $C_4$-$C_8$. Alternatively, a synthetic mixture of alkanes, preferably $C_4$-$C_8$, can be used. The solvent is added in an amount sufficient to precipitate asphaltenes—generally a solvent to froth ratio above 1.0 (w/w), preferably above 1.5 (w/w).

The process of the present invention can be used with any extraction process that meets the minimum criteria of (a) preparing a bitumen froth comprising particulate mineral and hydrocarbon solids collected in an aqueous lamellar phase in the form of an emulsion; (b) adding a sufficient amount of paraffinic solvent to the froth to induce inversion of the emulsion; (c) mixing the froth and the solvent for a sufficient time to dissolve the solvent in the bitumen; and (d) subjecting the mixture to gravity or centrifugal separation for a sufficient period to separate substantially all of the water and solids and a substantial portion of the asphaltenes from the bitumen. Any such process known to be useful to those of ordinary skill in the art of producing bitumen can be used with the present invention. In a preferred embodiment of the present invention, the process used is the Clark hot water extraction process as modified in U.S. Pat. Nos. 6,214,213 and 5,876,592. While this reference is directed primarily towards oilsands, the process of the present invention can be used with any source of crude bitumen including that recovered using in-situ methods from deep deposits.

In the practice of the present invention, the extraction process includes addition of a separation enhancing additive (SEA). The SEAs that are useful with the process of the present invention are polymeric surfactants. The polymeric surfactants have multiple lipophilic and hydrophilic moieties. In a preferred embodiment, the lipophilic moieties are aromatic, preferably alkylaryl, hydrocarbon groups and the hydrophilic moieties are hydroxylated, preferably polyether alcohol, groups. The alkylaryl hydrocarbon content of the molecule is preferably from about 15 to about 65 weight percent, preferably from about 40 to 60 weight percent. The total polyether alcohol content is preferably from about 35 to about 85 percent, preferably from about 40 to 60 weight percent. In a preferred embodiment, the polymeric surfactant has from about 2 to about 20, more preferably from about 4 to about 8 separate hydroxyl terminated chains. Other groups, such as other alkylene oxides, carboxylic acids, isothiocyanates, and the like may be present but are unnecessary unless used for connective purposes.

In a preferred embodiment, the SEAs have the general formula:

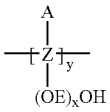

wherein A is an aromatic moiety, Z is a connecting moiety, and $(OE)_xOH$ is a hydroxy-terminal hydrophilic moiety wherein OE represents a polyether group. A can be any aromatic moiety, i.e. a cyclic structure with 4n+2 closed-shell pi-space electrons, including hydrocarbons such as benzene, styrene, naphthalene, biphenyl, anthracene, pyrene, fullerenes, and the like; heterocyclics, such as furan, pyrole, pyridine, purine, quinoline, porphyrins, and the like; and their conjugated oxides and nitrides, such as phenol, bisphenol, aniline, melamine, and the like; along with any alkyl groups connected thereto.

In the general formula, x is preferably from about 3 to about 30, more preferably from about 4 to about 12, and most preferably, from about 5 to about 8. Y is preferably from about 2 to about 20, more preferably from about 3 to about 12, and most preferably, from about 4 to about 8. The connecting moiety, Z, can by any moiety with sufficient bonds available to connect sufficient hydrophilic and lipophilic groups as set forth above. In a preferred embodiment, the A and $(OE)_xOH$ groups are on the same atom, in another preferred embodiment, the A and $(OE)_xOH$ groups are on adjacent atoms, and in other preferred embodiments, the A and $(OE)_xOH$ can be separated by a plurality of atoms. For example, in one embodiment, the Z moiety can be a polymer with A and $(OE)_xOH$ groups substituted onto the polymer backbone. In another embodiment, the Z moiety can be a copolymer backbone of separate A and $(OE)_xOH$ containing monomers. In any case, the horizontal bonds extending from the Z moiety are to represent polymerizations with terminal hydrogens or other appropriate atoms on the terminal groups. It is also an embodiment of the present invention where the repeating Z moieties can be different within the chain.

In the general formula, the $(OE)_xOH$ moiety is a hydrophilic moiety wherein OE represents an ether group. While the OE part of this moiety is preferably an oxyethylene group, other hydrophilic alkylene oxides can also be used. For the purpose of quantifying the OE content, other hydrophilic alkylene oxides, such as methylene and hydroxypropylene oxide, would be counted as equivalent to ethylene oxide but more hydrophobic alkylene oxides, such as propylene or butylene oxides, would not.

Examples of such SEAs include oxyalkylates of alkylphenol-formaldehyde condensates and oxyalkylates of alkylene bisphenol diglycidyl ethers having the above specified groups and content. The oxyalkylates of alkylphenol-formaldehyde condensates are preferably oxyethylates and, and more preferably, oxyethylates of a nonylphenolic condensate. The oxyalkylates of alkylene bisphenol diglycidyl ethers are preferably oxyethylates, and more preferably, oxyethylates of an oligo-(propylene bisphenol diglycidyl polyoxypropylate). A preferred SEA is a condensed nonylphenol-formaldehyde hexamer adducted with 55 weight percent ethylene oxide averaging six hydroxyl terminated chains averaging 6 moles ethylene oxides each.

The SEAs useful with the present invention can be added at any point in the process prior to and including the point at which the froth is mixed with solvent. The SEA can be added to the crude bitumen. It can be added during the frothing portion of the process. It can be added to the solvent prior to the solvent being admixed with the froth. Preferably, the SEAs are added to the process as far upstream in the process as possible to maximize their incorporation into the asphaltene structures of the bitumen to better ensure their co-precipitation. Addition to the bitumen prior to dilution with the paraffinic solvent is preferred, but addition at or after the point of mixing is adequate, provided it is sufficiently incorporated prior to the separation of the hydrocarbon phase from the non-hydrocarbon phase. Feeding the SEAs into the center of the suction of a bitumen pump is generally adequate for the purposes of the present invention.

Where practicable, the SEAs can be used neat, but are preferably dissolved in a solvent. The solvent must be sufficiently polar to dissolve the product but not so polar that it will not dissolve in the bitumen being processed. Exemplary solvents include aromatics such as xylenes, naphthas, and kerosenes, and oxygenates such as dry alcohols, ethers, and esters. Mixtures of these can also be used. The solvent content can vary from about 0 to about 90 percent depending on the viscosity and temperature handling requirements of the process equipment. Preferably the solvent is present at from about 40 to 70 percent.

When used according to the method of the present invention, the SEAs can function to reduce the viscosity of the non-solvated phase of the extraction. This phase, which would otherwise be a high viscosity or even solid phase, is much less viscous and can be removed from process vessels much more easily. This is in contrast to the prior art processes that increase separation rates at the expense of increasing the viscosity of the non-solvated phase.

In applying the process of the present invention, neither too little nor too much of the SEAs should be added to facilitate the removal of asphaltenes. It is preferable to use as little as needed in a given case to achieve a non-solvated phase with a viscosity low enough to enable removal. An excessive amount of SEAs can slow the settling of asphaltenes to the bottom. The optimum amount for each case will vary with the type and amount of bitumen, solvent, and asphaltenes present in the system, the amount and type of solids, and the amount of water entrained in the extracted froth. The process temperature, equipment type, and residence time of the extraction and settling process can also affect the amount of SEAs needed. The amount of SEAs needed may range from about 20 to about 2000 parts of SEAs per million parts of diluted bitumen. More preferably, the SEAs used with the process of the present invention will be from about 50 to about 800 parts of SEAs per million parts diluted bitumen. While the SEAs can be used with the process of the present invention at any temperature below their decomposition point, typically about 320° C., they are preferably used to facilitate processing at lower temperatures, preferably from about 40° C. to 80° C.

In addition to lowering the viscosity of the non-solvated phase of the bitumen froth solvent extraction process, the SEAs useful with the process of the present invention have another advantageous functionality. After the non-solvated phase has been removed from the vessel being used for the separation, it is desirable to recover as much of the entrained process solvent as possible. One problem with prior art processes is that these tailings tend to foam as the solvent is evaporated for recovery. Unlike typical monomeric surfactants, which often exacerbate foaming, use of the SEAs of the present invention actually eliminate or at least mitigate the foaming inherent in the matrix of this process, thereby facilitating solvent recovery.

EXAMPLES

The following examples are provided to illustrate the present invention. The examples are not intended to limit the scope of the present invention and they should not be so interpreted. Amounts are in weight parts or weight percentages unless otherwise indicated.

Example 1

A cylindrical pot is filled with one part bitumen recovered from froth flotation of Albertan oilsand, several parts of a mixture of pentanes and hexanes, and 160 ppm of SEA1. SEA1 is an ethoxylated acid-catalyzed nonylphenol-formaldehyde condensate having about 50 percent ethylene oxide groups and a molecular weight of about 3000 Daltons (as measured chromatographically relative to polystyrene). The contents are heated to the process temperature then mechanically mixed. The tube is allowed to sit at the process temperature for several minutes until the insoluble materials settle to the bottom. A rotating rake-like spindle is used to measure the viscosity of the asphaltic sludge on the bottom of the pot. The asphaltic sludge is fluid. It is tested for foam formation and is found to have very little foaming relative to Comparative Example I. The results are shown below in the table.

Example 2

Example 1 is repeated and tested substantially identically except that 480 part of SEA1 are used and the asphaltic sludge is not tested for foaming.

Example 3

Example 2 is repeated and tested substantially identically except that 160 parts of SEA2 are used. SEA2 is an ethoxylated acid-catalyzed nonylphenol-formaldehyde condensate having about 60 percent ethylene oxide groups and a molecular weight of about 3000 Daltons. This Example was not effective at this concentration in this system.

Example 4

Example 2 is repeated and tested substantially identically except that 480 parts of SEA2 are used, a dosage that is effective for the purpose of this process.

Comparative Example I

Example 1 is repeated and tested substantially identically except that no SEA is used.

Comparative Example II

Example 2 is repeated and tested substantially identically except that 600 ppm of Additive A is used. Additive A is an ethylene-vinyl acetate 9:1 copolymer having a molecular weight of 100,000 Daltons.

Comparative Example III

Example 2 is repeated and tested substantially identically except that 600 ppm of Additive B is used. Additive B is a linear dodecylbenzene sulfonic acid having a molecular weight of 300 Daltons.

Comparative Example IV

Example 2 is repeated and tested substantially identically except that 600 ppm of Additive C is used. Additive C is an ethoxylated propylene bisphenolic diglycidyl poly(propylene glycol) having a molecular weight of about 10,000 Daltons, a propylene oxide content of 75 percent and an ethylene oxide content of 20 percent.

Comparative Example V

Example 2 is repeated and tested substantially identically except that 480 ppm of Additive D is used. Additive D is an ethoxylated acid-catalyzed nonylphenol-formaldehyde poly (propylene oxide) having a molecular weight of 3000 Daltons and a propylene oxide content of 25 percent and an ethylene oxide content of 25 percent.

Comparative Example VI

Example 2 is repeated and tested substantially identically except that 480 ppm of Additive E is used. Additive E comprises oligo(acrylic/maleic) partial esters of ethoxylated poly(propylene glycol) and butyl/nonylphenol-formaldehyde poly(propylene oxide) having a molecular weight of about 30,000 Daltons and a propylene oxide content of 30 percent and an ethylene oxide content of 30 percent.

Comparative Example VII

Example 2 is repeated and tested substantially identically except that 480 ppm of Additive F is used. Additive F is an ethoxylated base-catalyzed nonylphenol-formaldehyde poly (propylene oxide) having a molecular weight of 3000 Daltons and a propylene oxide content of 35 percent and an ethylene oxide content of 35 percent.

Comparative Example VIII

Example 2 is repeated and tested substantially identically except that 600 ppm of Additive G is used. Additive G is an ethoxylated poly(propylene glycol) having a molecular weight of 4000 Daltons and a propylene oxide content of 60% and an ethylene oxide content of 40%.

TABLE

| Example # | Additive | Dosage | Sludge Viscosity | Foaming |
|---|---|---|---|---|
| 1 | SEA1 | 160 | Fluid | Low |
| 2 | SEA1 | 480 | Fluid | — |
| 3 | SEA2 | 160 | Solid | — |
| 4 | SEA2 | 480 | Fluid | — |
| Comparative I | NONE | — | Solid | High |
| Comparative II | A | 600 | Solid | — |
| Comparative III | B | 600 | Solid | — |
| Comparative IV | C | 600 | Solid | — |
| Comparative V | D | 480 | Solid | — |
| Comparative VI | E | 480 | Solid | — |
| Comparative VII | F | 480 | Solid | — |
| Comparative VIII | G | 600 | Solid | — |

What is claimed is:

1. A process for extracting bitumen from a matrix including mineral solids comprising:

a. preparing a bitumen froth comprising particulate mineral solids and hydrocarbons dispersed in aqueous lamella in the form of an emulsion;

b. adding a sufficient amount of a paraffinic solvent to the froth to induce inversion of the emulsion and precipitate asphaltenes from the resultant hydrocarbon phase;

c. mixing the froth and the solvent for a sufficient time to dissolve the solvent into the hydrocarbon phase to precipitate asphaltenes; and d. subjecting the mixture to gravity or centrifugal separation for a sufficient period to separate substantially all of the water and solids and a substantial portion of the asphaltenes from the bitumen;

wherein a separation enhancing additive is present in the process;

the separation enhancing additive is a polymeric surfactant having multiple lipophilic and hydrophilic moieties and an aromatic moiety content of from about 15 to about 65 weight percent; and the lipophilic moieties are lipophilic aromatic groups.

2. The process of claim 1 wherein the polymeric surfactant has an aromatic moiety content of from about 40 to 60 weight percent.

3. A process for extracting bitumen from a matrix including mineral solids comprising:

a. preparing a bitumen froth comprising particulate mineral solids and hydrocarbons dispersed in aqueous lamella in the form of an emulsion;

b. adding a sufficient amount of a paraffinic solvent to the froth to induce inversion of the emulsion and precipitate asphaltenes from the resultant hydrocarbon phase;

c. mixing the froth and the solvent for a sufficient time to dissolve the solvent into the hydrocarbon phase to precipitate asphaltenes; and d. subjecting the mixture to gravity or centrifugal separation for a sufficient period to separate substantially all of the water and solids and a substantial portion of the asphaltenes from the bitumen;

wherein a separation enhancing additive is present in the process;

the separation enhancing additive is a polymeric surfactant having multiple lipophilic and hydrophilic moieties;

the hydrophilic moieties are hydroxylated hydrophilic polyether groups;

the lipophilic moieties are lipophilic aromatic groups; and the polymeric surfactant has a hydroxylated hydrophilic polyether content of from about 35 to about 85 percent.

4. The process of claim 3 wherein the polymeric surfactant has a hydroxylated hydrophilic polyether content of from about 40 to about 60 percent.

5. A process for extracting bitumen from a matrix including mineral solids comprising:

a. preparing a bitumen froth comprising particulate mineral solids and hydrocarbons dispersed in aqueous lamella in the form of an emulsion;

b. adding a sufficient amount of a paraffinic solvent to the froth to induce inversion of the emulsion and precipitate asphaltenes from the resultant hydrocarbon phase;

c. mixing the froth and the solvent for a sufficient time to dissolve the solvent into the hydrocarbon phase to precipitate asphaltenes; and d. subjecting the mixture to gravity or centrifugal separation for a sufficient period to separate substantially all of the water and solids and a substantial portion of the asphaltenes from the bitumen;

wherein a separation enhancing additive is present in the process;

the separation enhancing additive is a polymeric surfactant having multiple lipophilic and hydrophilic moieties;

the lipophilic moieties are lipophilic aromatic groups; and the polymeric surfactant has the general formula:

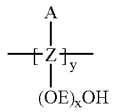

wherein A is an aromatic moiety, Z is a connecting moiety, and $(OE)_xOH$ is a hydrophilic moiety wherein OE represents a hydrophilic polyether group, x is an integer of from about 3 to about 30, and y is an integer of from about 2 to about 20.

6. A process for extracting bitumen from a matrix including mineral solids comprising:

a. preparing a bitumen froth comprising particulate mineral solids and hydrocarbons dispersed in aqueous lamella in the form of an emulsion;

b. adding a sufficient amount of a paraffinic solvent to the froth to induce inversion of the emulsion and precipitate asphaltenes from the resultant hydrocarbon phase;

c. mixing the froth and the solvent for a sufficient time to dissolve the solvent into the hydrocarbon phase to precipitate asphaltenes; and d. subjecting the mixture to gravity or centrifugal separation for a sufficient period to separate substantially all of the water and solids and a substantial portion of the asphaltenes from the bitumen;

wherein a separation enhancing additive is present in the process;

the separation enhancing additive is a polymeric surfactant having multiple lipophilic and hydrophilic moieties;

the lipophilic moieties are lipophilic aromatic groups; and the separation enhancing additive is selected from the group consisting of alkoxylates of alkylphenol-formaldehyde condensates, alkoxylates of alkylene bisphenol diglycidyl ethers, and mixtures thereof.

7. The process of claim 6 wherein the separation enhancing additive is a additive is a condensed nonylphenol-formaldehyde hexamer adducted with 50 percent by weight ethylene oxide averaging about six hydroxyl terminated chains averaging about six moles ethylene oxide each.

8. The process of claim 1 wherein the separation enhancing additive is added to the bitumen froth prior to addition of solvent.

9. The process of claim 8 wherein the separation enhancing additive is dissolved in an additive solvent prior to its addition to the bitumen froth.

10. The process of claim 9 wherein the additive solvent is selected from the group consisting of xylenes, naphthas, kerosenes, dry alcohols, ethers, esters, and mixtures thereof.

11. The process of claim 1 wherein the separation enhancing additive is present at a concentration of from about 20 to about 2000 parts of separation enhancing additive per million parts of diluted bitumen.

12. The process of claim 11 wherein the separation enhancing additive is present at a concentration of from about 50 to about 800 parts of separation enhancing additive per million parts of diluted bitumen.

* * * * *

UNITED STATES PATENT AND TRADEMARK OFFICE
Certificate

Patent No. 7,357,857 B2 Patented: April 15, 2008

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is:
Paul R. Hart, Sugar Land, TX (US); Edward M. Maharajh, Calgary (CA); and Scott J. Fryer, Calgary (CA).

Signed and Sealed this Twelfth Day of October 2010.

GLENN A. CALDAROLA
*Supervisory Patent Examiner*
Art Unit 1797
Technology Center 1700